US005746359A

United States Patent [19]

Stanek et al.

[11] Patent Number: 5,746,359

[45] Date of Patent: May 5, 1998

[54] AIR SEAL FOR HUMIDIFIER WATER BOTTLE

[75] Inventors: Terrence L. Stanek, St. Charles; Mark J. Tomasiak, O'Fallon, both of Mo.

[73] Assignee: Emerson Electric Co., St. Louis, Mo.

[21] Appl. No.: 660,093

[22] Filed: Jun. 6, 1996

[51] Int. Cl.[6] ..... B01F 3/04

[52] U.S. Cl. ..... 222/542; 222/482; 222/549; 220/304; 220/378; 261/72.1

[58] Field of Search ..... 222/482, 542, 222/549, 562; 261/72.1; 220/304, 378

[56] References Cited

U.S. PATENT DOCUMENTS

| | | | |
|---|---|---|---|
| 85,236 | 12/1868 | Myers | 220/304 |
| 1,802,898 | 4/1931 | Hothersall | 220/304 |
| 2,171,302 | 8/1939 | Conner | 222/542 |
| 2,616,584 | 11/1952 | Rausenberger et al. | 220/378 |
| 3,729,122 | 4/1973 | Flider | 222/482 |
| 3,878,600 | 4/1975 | Gilbert | 220/378 |
| 4,168,128 | 9/1979 | Fillmore et al. | 222/562 |
| 4,276,241 | 6/1981 | Stewart et al. | 261/92 |
| 4,569,460 | 2/1986 | Bondy | 220/378 |
| 4,699,292 | 10/1987 | Farrell | 220/378 |
| 4,781,314 | 11/1988 | Schoonever et al. | 220/482 |
| 5,061,405 | 10/1991 | Stanek et al. | 261/72.1 |
| 5,071,140 | 12/1991 | Rio | 220/378 |
| 5,074,428 | 12/1991 | Wildfeuer | 220/378 |
| 5,286,942 | 2/1994 | McFadden et al. | 219/630 |
| 5,354,515 | 10/1994 | Ushimaru | 261/72.1 |
| 5,405,040 | 4/1995 | Keller | 220/304 |
| 5,480,588 | 1/1996 | Tomasiak et al. | 261/72.1 |
| 5,482,190 | 1/1996 | Stanek et al. | 222/501 |

*Primary Examiner*—J. Casimer Jacyna
*Attorney, Agent, or Firm*—Arnold, White & Durkee

[57] ABSTRACT

A water bottle for use in a humidifier is disclosed. The water bottle includes a bottom wall, a top wall and a circumferentially extending side wall extending between the bottom wall and top wall. A selective water dispenser, generally in the form of a water bottle dispensing cap, is mounted over a water dispensing opening formed in one of the walls of the water bottle. An air seal is provided for a water filling opening that is formed in one of the walls of the water bottle. The air seal, independent of a water seal, utilizes negative pressure differential in the water bottle that is generated during the dispensing of the water through the water dispensing opening to provide a vacuum air seal for the water filling opening independent of the pressure that may be required to complete the water seal for the water filling opening.

23 Claims, 5 Drawing Sheets

AIR SEAL FOR HUMIDIFIER WATER BOTTLE

BACKGROUND OF THE INVENTION

The present invention relates to a water bottle for use in a humidifier, and more particularly, to a water bottle which provides a primary water seal and a secondary air seal for a water filling opening, the secondary air seal being independent of pressure necessary to complete the water seal so as to prevent air entry and subsequent water dispensing regardless of the amount of pressure applied.

Humidifiers are used to overcome low moisture conditions in heated rooms, particularly during the winter season. The beneficial effects of humidifiers are numerous and include: protection to the respiratory system of the user, assisting the body defenses of the user against viruses and air pollutants, reducing dryness and irritation in the user's nose and throat, alleviate atopic dermatitis attributable to dry air, as well as other non-health benefits including reduction in static electricity, protection of wood furniture, paneling and fabrics, and even the protection of computers from excessive dry warm air.

Since humidifiers must be filled with water, several different systems have been developed over the years. Some humidifiers include a refillable water compartment that requires the carrying of separate containers or buckets of water to refill the compartment. In some cases, a humidifier mounted on casters can be wheeled directly to the water source. In other cases, a separable reservoir can be moved to the water source and repositioned relative to the humidification unit of the humidifier. The current trend; however, includes the use of detachable refillable containers or bottles which are removed from the humidifier, filled at a water source, and then reassembled in the humidifier unit.

Such detachable refillable containers or bottles include a water dispensing opening in a bottom wall or lower end secured by a water dispensing cap with a selective water dispensing mechanism for gravity feeding water into a water reservoir at the bottom of the humidifier. Because the water dispensing opening must be positioned at the lower end or the bottom wall in the longest dimension of the detachable refillable container or bottle, it is difficult to use the water dispensing opening also as the fill opening since it is most cumbersome to position an elongated container or bottle under a standard faucet for filling. Where the dispensing opening and/or separate water filling opening is provided in the lower end or bottom wall of a container or bottle, additional equipment must sometimes be used to assist in filling the bottle or container including a hose or other suitable filling equipment.

Some manufacturers have elected to place the water filling opening in a side wall or top wall of the bottle or container, in an attempt to alleviate the problems associated with bottom filling. One particularly unique approach uses a water filling cap that is releasably mounted over a water filling opening formed in the side wall of the water bottle or container to facilitate filling, as described in U.S. Pat. No. 5,480,588. Since the width of such water bottles or containers is much less than the length, it is a relatively easy matter to rotate the bottle to enable quick and easy filling of the water bottle or container through the water filling opening provided in the side wall of the water bottle or container.

Where the water filling opening is located in a wall other than the bottom wall of the water bottle or container, such as the side wall or top wall, the water filling opening is susceptible to air leaks into the bottle. Such air leaks are due to the fact that users do not apply sufficient pressure in threadably mounting a water filling cap over a threaded mounting surrounding the water filling opening. As a result, the typical water seal provided in a water filling cap may not be sufficiently tightened or brought into sealing engagement, causing air leaks to occur. These air leaks result in the total contents of the water bottle or container emptying into the humidifier and overflowing the water reservoir.

The present invention overcomes these aforementioned problems by providing an air seal that is independent of pressure that may be required to compress a water seal in a water filling cap and is only dependent on contact with a sealing surface. As the humidifier begins dispensing water through a water dispensing opening, a negative air pressure or vacuum is generated in the water bottle or container after the designed water level exterior to the bottle has been reached. This negative air pressure, after an initial contact of an air seal with a sealing surface, draws the air seal of the present invention into sealing engagement with a sealing surface surrounding the water filling opening, thus preventing air from entering the water bottle or container, and preventing any further leaking of water.

SUMMARY OF THE INVENTION

Among the several objects and advantages of the present invention include:

- The provision of a new and improved water bottle for humidifiers;
- The provision of the aforementioned water bottle for humidifiers which is constructed to prevent leaks;
- The provision of the aforementioned water bottle for humidifiers which prevents water leaks by eliminating air leaks around a water filling opening or orifice;

The provision of the aforementioned water bottle for humidifiers which prevents air leaks through a water filling opening or orifice independent of the pressure necessary to secure a water filling cap relative to the water filling opening;

- The provision of the aforementioned water bottle for humidifiers which prevents air leaks through a water filling opening located in a side wall or top wall of the water bottle;
- The provision of the aforementioned water bottle for humidifiers which includes a primary water seal and a secondary air seal for the water filling opening or orifice of a humidifier bottle;
- The provision of the aforementioned water bottle for humidifiers in which the secondary air seal is established when water is dispensed through a water dispensing opening of the water bottle;
- The provision of the aforementioned water bottle for humidifiers in which the secondary air seal utilizes a negative pressure differential in the water bottle that is generated during the dispensing of the water through a water dispensing opening to provide a vacuum air seal for the water filling opening independent of the pressure applied in the releasable mounting of a water filling cap relative to the water dispensing opening;
- The provision of the aforementioned water bottle for humidifiers which is further constructed to facilitate the filling and dispensing or water from the water bottle; and
- The provision of the aforementioned water bottle for humidifiers which is simple to manufacture using well known blow moldings and injection molding techniques; is easy to use and maintain; is durable and long lasting; and is otherwise well adapted for the purposes intended.

Briefly stated, the present invention discloses a water bottle for use in a humidifier. The water bottle includes a bottom wall, a top wall and a circumferentially extending side wall connecting the bottom wall and top wall. A selective water dispenser is provided for a water dispensing opening formed in one of the walls of the water bottle. An air seal is provided for a water filling opening formed in one of the walls of the water bottle. The air seal is established when water is dispensed through the water dispensing opening of the water bottle.

The water filling opening is preferably formed in the side wall of the water bottle, although it can be formed in the top wall, as well.

The selective water dispenser is preferably a dispensing cap with a selective water dispensing mechanism.

The water seal preferably is a cap having an internally threaded wall that is threadably mounted over an externally threaded collar surrounding the water filling opening. A water seal is provided within the internally threaded wall of the cap.

The air seal includes a diaphragm mounted to or otherwise associated with the cap for sealingly engaging a circumferential margin within the externally threaded collar that surrounds the water filling opening. The circumferential margin surrounding the water filling opening preferably includes a raised lip for engaging the diaphragm. The diaphragm is preferably a foam plastic element.

The water seal preferably is a compressible gasket sealed between the water filling cap and water bottle filling collar. Preferably also, the compressible gasket includes a double surface seal construction.

A water bottle dispensing cap may be mounted over a water dispensing opening formed in the bottom wall of the water bottle while a water filling cap is releasably mounted over a water filling opening formed in one of the other walls of the bottle. The water filling cap includes the air seal which utilizes the negative pressure differential in the water bottle that is generated during the dispensing of the water through the water dispensing opening to provide a vacuum air seal for the water filling opening independent of the pressure applied to the releasable mounting of the water filling cap relative to the water filling opening.

The water filling opening formed in one of the walls of the water bottle includes a circumferentially extending raised lip surrounding the water filling opening, a circumferential collar including a raised laterally extending circumferential surface extends above and surrounds the raised lip, and an externally threaded wall is provided along an outer periphery of the circumferential collar. For association with the water filling opening, a water filling cap is provided including an internally threaded outer periphery for threadable engagement with the externally threaded wall of the circumferential collar. A compressible gasket seal within the internally threaded outer periphery is provided for engaging the raised laterally extending circumferential surface of the circumferential collar to provide a water seal, and a foam diaphragm is provided for engaging the raised lip surrounding the water dispensing opening to provide an air seal when water is dispensed through the water dispensing opening.

The top wall includes a centrally positioned handle for carrying and maneuvering the water bottle, while the water filling opening in the side wall of the water bottle is also preferably centrally positioned in the water bottle. A recessed area in the water bottle also surrounds the water filling opening.

These and other objects and advantages of the present invention will become apparent from the description that follows.

BRIEF DESCRIPTION OF THE DRAWINGS

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

Figure 1:
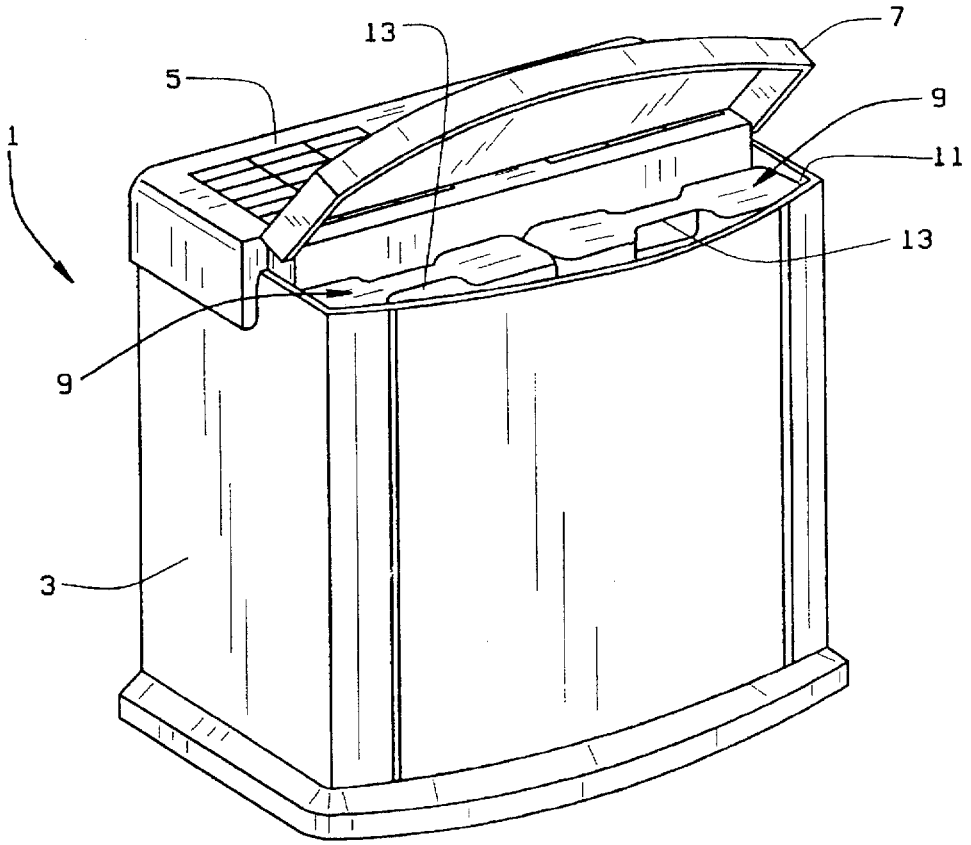
FIG. 1 is a perspective view of a typical wicking element type humidifier which uses water bottles that are constructed in accordance with the teachings of the present invention.

The present invention relates to a water bottle for use in humidifiers, particularly wicking type humidifiers of the type illustrated in FIG. 1 of the drawings. The humidifier 1 includes a cabinet 3 containing a water reservoir and a humidification unit including wicking elements of the type disclosed in U.S. Pat. Nos. 4,865,775, 5,061,405, 5,480,588 and co-pending patent application Ser. No. 08/466,584 filed Jun. 6, 1995, entitled HUMIDIFIER HAVING MULTI-STAGE FANS AND METHOD FOR MULTI-STAGE OPERATION, now U.S. Pat. No. 5,573,713. The construction of the humidifier 1 itself forms no part per se of the present invention; however, it be will understood that a wicking element (not shown) is supported within the cabinet 3 and includes a lower end that is positioned within a water reservoir (not shown) to enable water to be transferred by capillary action upwardly into the wicking element (not shown) to enable an electric fan (not shown) at an upper end of the cabinet 3 to blow or draw air through the wicking element (not shown) in order to transfer water to the atmosphere.

At the upper end of cabinet 3 is a cover 5 and pivoting lid 7. When the pivoting lid 7 is moved upwardly as illustrated in FIG. 1, a pair of water bottles 9 are shown as received within a compartment 11 of the cabinet base 3.

Figure 2:
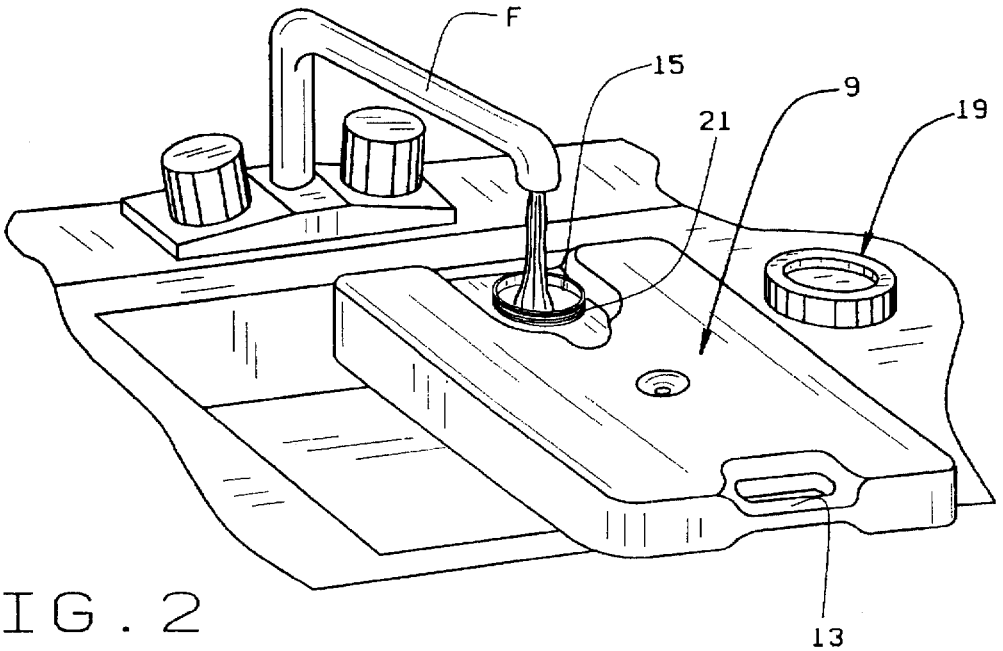
FIG. 2 is a perspective view of a water bottle constructed in accordance with the teachings of the present invention incorporating a side opening to facilitate filling of the water bottle from a water faucet, as illustrated.

Each of the water bottles 9 include an integral handle 13 at an upper end to enable the bottles 9 to be removed from the compartment 11 of the container base for filling, as illustrated in FIG. 2 of the drawings. As disclosed in U.S. Pat. No. 5,480,588, the water bottle 9 preferably includes a side filling opening 15 to facilitate filling of the bottle 9. As a result, each water bottle 9 can be rotated to the position illustrated in FIG. 2 for easy positioning under a water faucet F to allow filling of each water bottle 9 through the water filling opening 15. After each water bottle 9 is suitable filled, the user can threadable mount the water filling cap 19 relative to the externally threaded collar 21 that surrounds the water filling opening 15.

Each water bottle 9 also includes a water dispensing cap 23 that is threadably mounted over an externally threaded collar 25 that surrounds a water dispensing opening 27 located in the bottom of each water bottle 9. Each dispensing cap includes a spring mounted plunger valve 29 that operates as a dispensing mechanism when moved from the position illustrated in FIG. 4 to an open position in FIG. 5 by a stem (not shown) within the water reservoir (not shown) of the humidifier 1, as is common. When the plunger valve 29 is moved to the position illustrated in FIG. 5, water within the water bottle 9 will be dispensed through a dispensing cap opening 31 to the reservoir (not shown). Water will flow from the water bottle until the designed water level has been reached, at which point water flow is stopped.

When water flow is initiated through the water dispensing opening 31 in the dispensing cap 23 as discussed above, a vacuum or negative air differential will be created within the water bottle when the designed water level WL is reached. If a water filling opening is located in the bottom of the water bottle, as in the dispensing opening 27, then water will not leak from the water filling opening since water would have reached its own level within the water reservoir, thus shutting off air entry and the water flow.

However, if a water filling opening is located in the side of the water bottle or any other location including the top of the water bottle; there is a tendency for air to leak from and around a water filling opening, and consequently, water will continue to flow from the dispensing opening after the designed water level is reached.

In the preferred embodiment, the filling opening is located in the side of the water bottle 9 as illustrated in filling opening 15, and the water filling cap 19 is used for threadably closing the opening through the threadably mounted filling cap 19 that threadably mates with the externally threaded collar 21 surrounding the water filling opening 15.

If a user suitably tightens the water filling cap 19 to effectively engage a water seal within the water filling cap 19, then water and air leaking would be prevented; however, different users apply different amounts of pressure in threadably mounting a water filling cap relative to the externally threaded collar 21 surrounding the water filling opening 15. As a result, a vacuum or negative air differential that is established within the water bottle 9 when the water is dispensed creates the susceptibility of the water filling opening 15 to air leaks. Such air leaks result in the total contents of the water bottle 9 emptying into the humidifier reservoir and overflowing the reservoir. The susceptibility of leaking air is a result of the dependency of the end user to apply a sufficient tightening pressure and threadably securing the filling cap 19 to the externally threaded collar 21 surrounding the filling opening 15.

Figure 5:
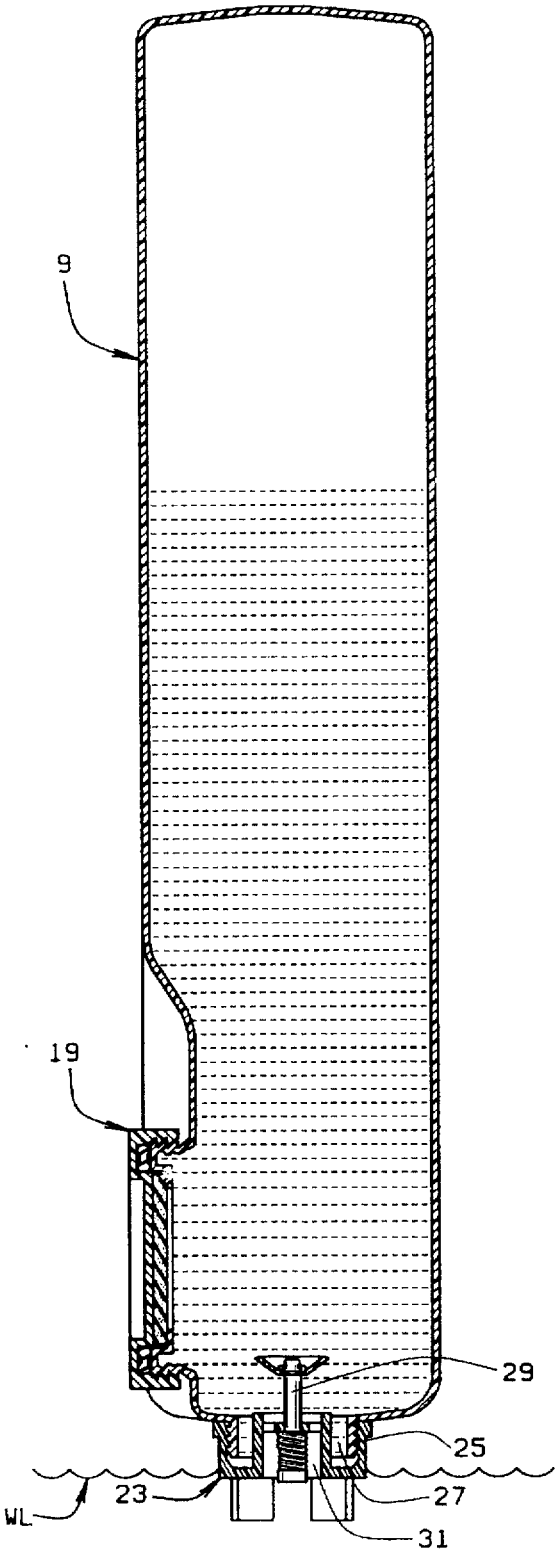
FIG. 5 is a side elevational view, partly in section, of the water bottle after the dispensing mechanism in the dispensing cap is activated to initiate water flow and the creation of a negative air differential within the water bottle.

According to the present invention, an air seal for the water filling cap 19 is provided that is independent of applied pressure. As the humidifier bottle begins dispensing water through the water dispensing opening 31, as shown in FIG. 5, a negative pressure or vacuum is generated within the water bottle 9 after the designed water level WL is reached. This negative pressure differential, after an initial contact of the air seal with a sealing surface, draws the air seal into sealing engagement in order to prevent air from entering the water bottle 9, thus preventing any air leaks around the water filling cap 19.

Figure 6:
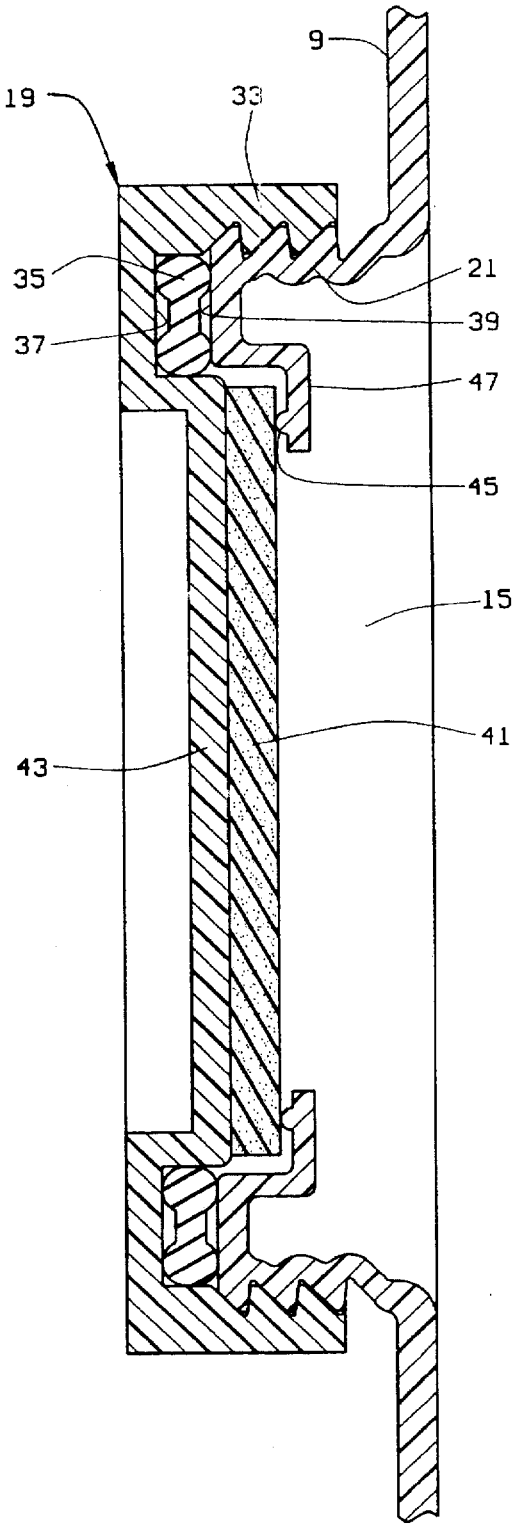
FIG. 6 is an enlarged fragmentary sectional view of a water filling cap, including water seal and air seal, prior to the creation of a negative air differential within the water bottle.
Figure 7:
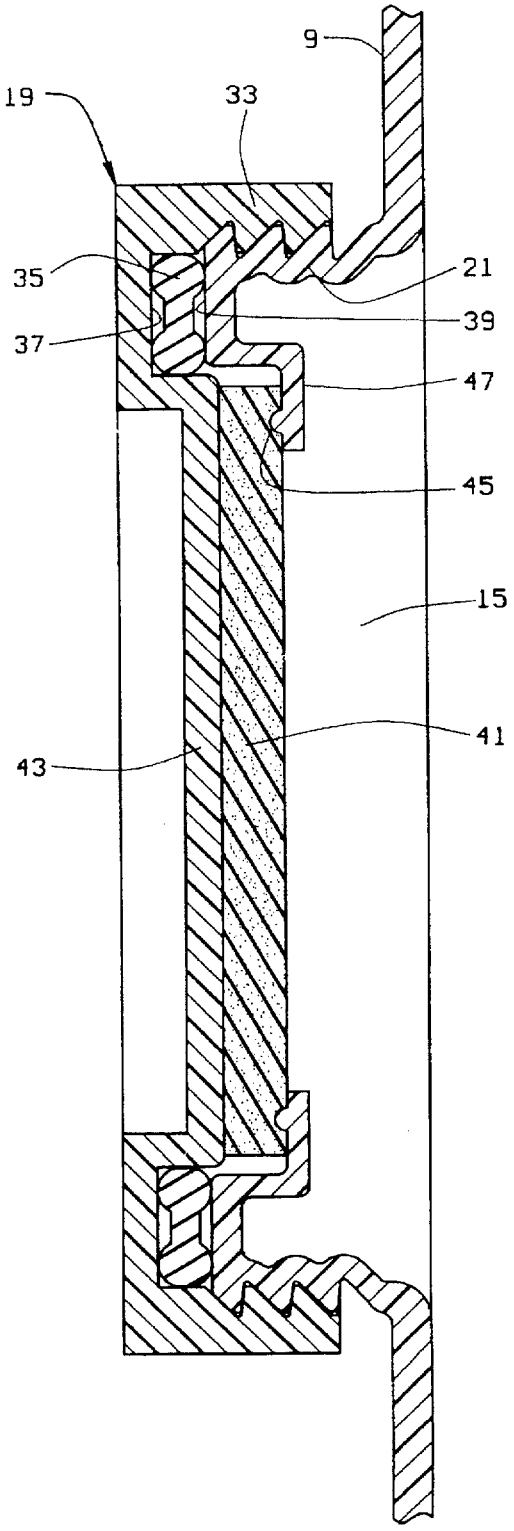
FIG. 7 is an enlarged fragmentary sectional view of the water filling cap, including water seal and air seal, after the initiation of a negative air differential within the water bottle, in order to prevent any air leaks.

This is best illustrated in comparing FIGS. 6 and 7 of the drawing. FIG. 6 illustrates the dispensing cap prior to the activation of the air seal, while FIG. 7 illustrates the air seal established as a result of the negative pressure differential or vacuum in the water bottle as shown in FIG. 5 of the drawings.

FIGS. 6 and 7 of the drawings also illustrate the water filling opening 15 with the external threaded collar 21 that is in complementary threaded engagement with an internally threaded outer periphery 33 of the water filling cap 19. A compressible gasket seal 35, shown in FIGS. 6 and 7 to be a double sealing surface compressible gasket seal 35 is received within a circumferential depression or well 37 formed in the water filling cap 19. The double surface compressible gasket seal 35 is positioned for engagement with a raised laterally extending circumferential surface 39 adjacent to the externally threaded circumferential collar 21 of the water bottle.

Extending within the double compressible gasket seal 35 is a foam plastic diaphragm 41 that is secured by adhesion or is otherwise located on an inside face of the circular shaped depression or well 43 in the water filling cap 19. The foam plastic element 41, at its outer margin or periphery, engages a raised lip 45 that is part of a circumferential shelf 47 surrounding the water filling opening 15, the shelf 47 being integrally connected to the externally threaded circumferential collar 21, as illustrated in FIGS. 6 and 7 of the drawings.

Figure 4:
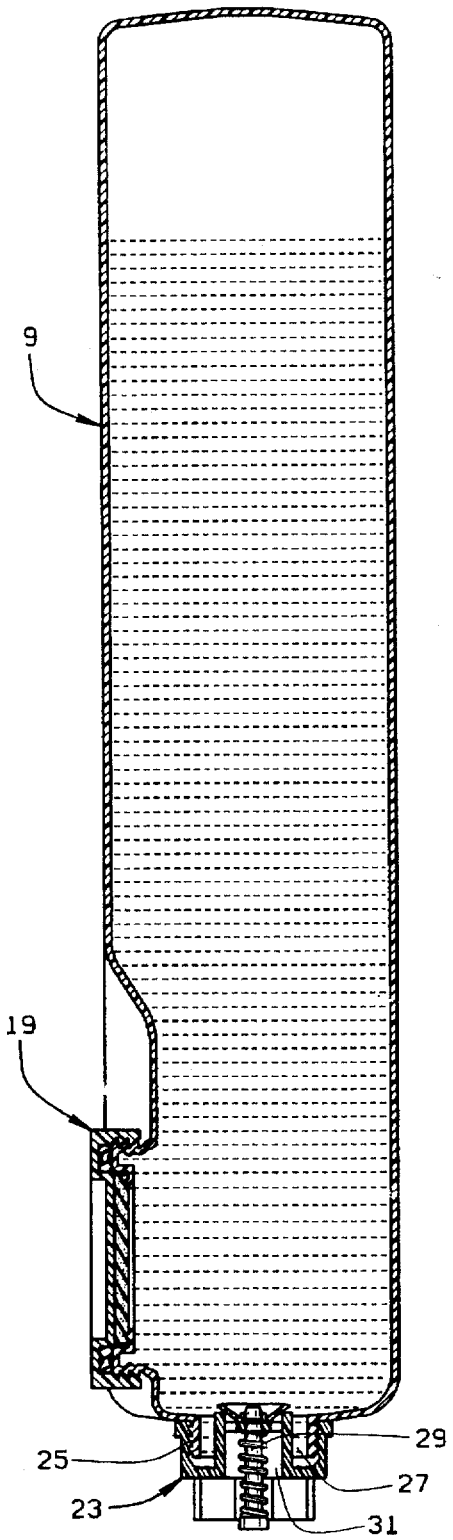
FIG. 4 is a side elevational view, partly in section, illustrating the water bottle prior to engagement of a water dispensing mechanism in a dispensing cap at the lower end of the water bottle.

FIG. 6 represents the water filling cap 19 prior to the establishment of a negative pressure differential or vacuum as shown in FIG. 4 of the drawings, while FIG. 7 represents an air seal being established through engagement of the diaphragm 41 with the raised lip 45 and shelf 47 that surrounds the water filling opening 15, as a result of the negative air differential or vacuum being established within the water bottle 9, as shown in FIG. 5 of the drawings.

As indicated above, the water filling cap 19 is susceptible to air leaks since a user may not adequately tighten the water filling cap 19 on the externally threaded collar 21 of the water bottle 9 to adequately compress the compressible gasket water seal 35 against the raised circumferentially extending surface 39 surrounding the water filling opening 15. However, as a negative pressure differential or vacuum is created within the water bottle, as shown in FIG. 5 of the drawings when water is dispensed through the dispensing opening 31 of the water dispensing cap 23, the negative pressure differential draws the diaphragm or secondary air seal 41 inwardly, from the position shown in FIG. 6 where the air seal 41 is in initial contact with the sealing surface or raised lip 45 to that shown in FIG. 7, where the outer margin or periphery of the air seal 41 is drawn into aggressive impingement and/or contact with the raised lip 45 and shelf 47 surrounding the water filling opening 15. As a result, regardless of the amount of tightening pressure applied to the water filling cap 19, an air seal will be established around the water filling opening 15, as a result of the engagement of the outer periphery of the diaphragm 41 with the raised lip 45 and shelf 47 surrounding the water filling opening 15.

The primary water seal, through the compressive engagement of the double compressible gasket seal 35 with the raised circumferential surface 39, is thus further enhanced by the effectiveness of the diaphragm or secondary air seal 41 that is established around its outer periphery or margin when a negative air differential is created within the water bottle 9 as water is dispensed through the water dispensing opening of the dispensing cap 23.

It will be understood that the diaphragm or secondary air seal can be made of any type of material in any thickness desired. For example, metal, rubber or plastic diaphragm elements may be used in different thicknesses depending on the material used In the present description, foam plastic, preferably a skinned-over closed cell cross linked polyethylene foam material, is shown to be one such effective material.

Figure 3:
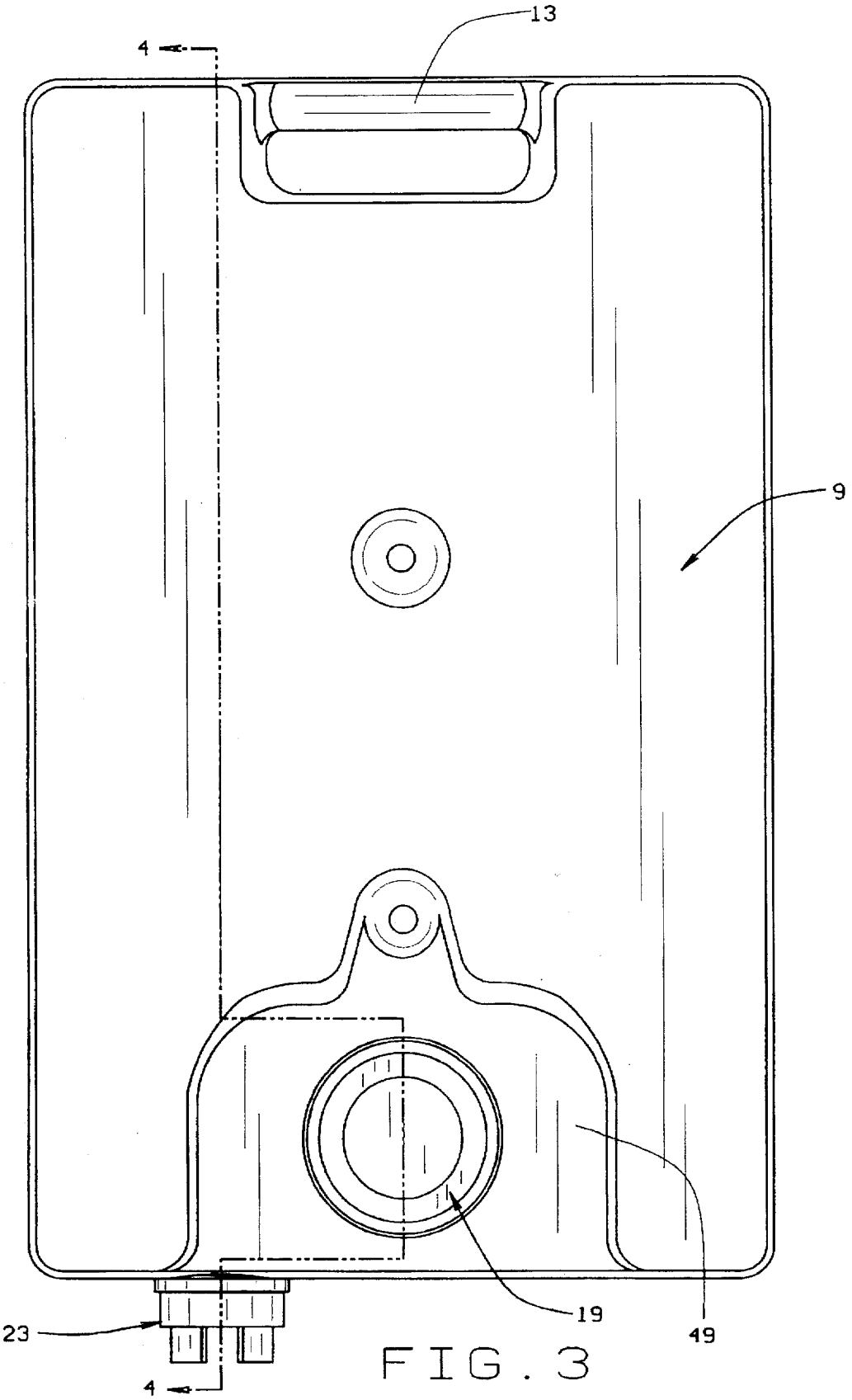
FIG. 3 is an enlarged side elevational view of the water bottle of the present invention.

Additional features of the water bottle 9 include a centrally positioned handle 13, as shown in FIG. 3 of the drawings, which corresponds to the centrally positioned location of the water filling cap 19 that surrounds the water filling opening 15 in the side wall of the water bottle 9. The centrally positioned handle 13 facilitates carrying and maneuvering of the water bottle 9 in removing, filling and returning the water bottle 9 to the cabinet 3 of the humidifier 1. FIG. 3 of the drawings further illustrates a recessed area 49 in the water bottle around the water filling cap 19 and the water filling opening 15. This strengthens the area of the bottle around the water filling cap to maintain flatness, while allowing better access to the water filling cap 19 for tightening purposes. The recessed area 49 also serves as a path to drain excess water away from the end user during the filling process.

Figure 8:
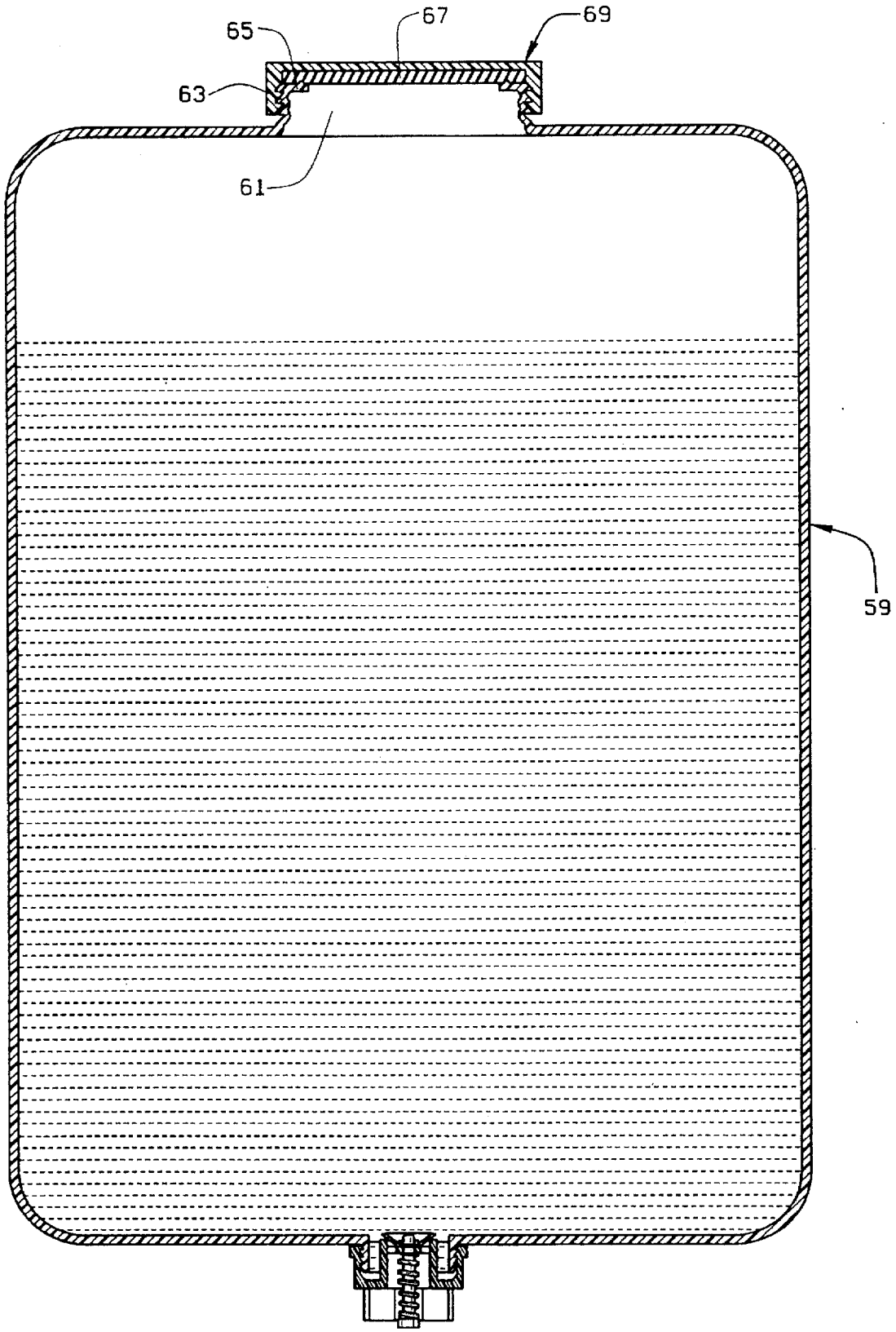
FIG. 8 is an enlarged fragmentary sectional view of an alternative embodiment of the present invention.

FIG. 8 of the drawings illustrates an alternative embodiment of the present invention. In this embodiment, the water bottle 59 includes a water filling opening 61 in the top wall of the water bottle 59. An upwardly extending collar 63 surrounds the water filling opening and includes an inwardly directed shelf or support 65 that serves as a sealing surface. The upwardly extending collar 63 may be externally threaded for threadable association relative to the water filling lid 65, in a manner similar to the embodiment illustrated in FIGS. 1–7 of the drawings. Of course, any type of releasable mounting mechanism may be used for securing the water filling cap 69 relative to the collar 63, as will be appreciated. Within the water filling cap 69 is an air seal diaphragm 67 that extends across the water filling opening 61 and rests on the supporting shoulder or shelf 65. The air seal diaphragm 67 may be made of any suitable material, but preferably is a foam plastic element similar to that preferred in the FIGS. 1–7 embodiment.

The air seal diaphragm 67 is also independent of applied pressure applied through the water filling cap 69 in its releasable mounting to the upstanding collar 63. Thus, as the humidifier bottle 59 begins to dispense water, through a suitable water dispensing mechanism (not shown) in one of the walls of the water bottle 59, a negative air pressure is generated within the water bottle 59 and draws the air seal diaphragm 67, after its initial contact with the supporting shoulder or shelf 65, into sealing engagement with the supporting shoulder or shelf 65 that serves as a complementary sealing surface for the air seal diaphragm 67. This prevents air from entering the water bottle so as to eliminate air leaks and resulting water leaks, as well.

It will be appreciated that the air seal diaphragm 67 also functions, at least in part, as a water seal so as to prevent water splashing within the bottle during the carrying of the water bottle 59 to and from a water source. Of course, the water sealing capabilities of the air seal diaphragm 67 will be dependent upon the applied pressure applied through the water filling cap 69 and its releasable mounting to the water bottle 59.

It will be further understood that the embodiment shown in FIG. 8 may also be used in the sidewall of the water bottle 59 with generally the same result; however, it is likely that some additional water leaking may occur in the carrying of the water bottle 59 to and from and water source due to the negative air pressure within the water bottle 59 that would apply force against the air seal diaphragm 67.

In all other respects, the embodiment shown in FIG. 8 of the drawings operates in the same manner described in connection with the embodiment shown in FIGS. 1–7 of the drawings.

From the foregoing, it will now be appreciated that the present invention discloses a novel and unique water and air seal for humidifier water bottles. The primary water seal, in the form of a commonly used compressible gasket, functions well when placed into compressive engagement between a water filling cap and a corresponding surface of the water bottle. However, this does not always occur as end users apply different amounts of pressure in rotatably threading a water filling cap relative to an externally threaded collar surrounding a water filling opening of the water bottle. To overcome the susceptibility to water leaks as a result of inadequate tightening, the present invention provides a secondary air seal which is independent of applied pressure. As the humidifier bottle begins to dispense water, a negative air pressure is generated within the water bottle and draws the secondary air seal, after its initial contact with a bottle sealing surface, into aggressive impingement with a bottle sealing surface to prevent air from entering the water bottle when the designed water level is reached. As a result, air leaks are prevented and this also eliminates water leaks as well, regardless of the amount of pressure applied in threadably tightening the water filling cap relative to an externally threaded collar surrounding the water filling opening.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A water bottle for use in a humidifier comprising:

a bottom wall, a top wall and a circumferentially extending side wall connecting the bottom wall and top wall;

a selective water dispenser for a water dispensing opening formed in one of the walls of the water bottle;

a water seal for a water filling opening formed in one of the walls of the water bottle, the water seal being formed by the application of pressure to a water sealing member; and an air seal for the water filling opening, the air seal being established when water is dispensed through the water dispensing opening of the water bottle such that a negative pressure is established in the water bottle, the strength of the air seal being substantially independent of the pressure applied to the water sealing member.

2. The water bottle as defined in claim 1 in which the water filling opening is formed in the sidewall of the water bottle.

3. The water bottle as defined in claim 1 in which the water filling opening is formed in the top wall of the water bottle.

4. The water bottle as defined in claim 1 in which the selective water dispenser is a dispensing cap with a selective water dispensing mechanism.

5. The water bottle as defined in claim 1 in which the water seal includes a cap having an internally threaded wall that is threadable mounted over an externally threaded collar surrounding the water filling opening.

6. The water bottle as defined in claim 5 in which the air seal includes a diaphragm associated with the cap for sealingly engaging a circumferential margin within the externally threaded collar that surrounds the water filling opening.

7. The water bottle as defined in claim 6 in which the circumferential margin surrounding the water filling opening includes a raised lip for engaging the diaphragm.

8. The water bottle as defined in claim 7 in which the diaphragm is a foam plastic element.

9. A water bottle for use in a humidifier comprising:

a bottom wall, a top wall and a circumferentially extending side wall connecting the bottom wall and top wall;

a selective water dispenser for a water dispensing opening formed in one of the walls of the water bottle; and an air seal for a water filling opening formed in one of the walls of the water bottle, the air seal being established when water is dispensed through the water dispensing opening of the water bottle; and a water seal including a cap having an internally threaded wall that is threadable mounted over an externally threaded collar surrounding the water filling opening;

wherein the air seal includes a diaphragm associated with the cap for sealingly engaging a circumferential margin within the externally threaded collar that surrounds the water filling opening, the diaphragm comprising a foam plastic element and the circumferential margin including a raised lip for engaging the diaphragm;

and wherein the water seal comprises a compressible gasket seal between the diaphragm and the internally threaded wall of the cap for engaging a raised circumferential surface between the raised lip and the externally threaded collar that surrounds the water filling opening.

10. The water bottle as defined in claim 9 in which the compressible gasket includes a double sealing surface compressible gasket construction.

11. In a water bottle for use in a humidifier in which the water bottle includes a bottom wall, a top wall and a circumferentially extending side wall connecting the bottom wall and top wall and is further provided with a selective water mechanism for a water dispensing opening in one of the walls of the water bottle, the improvement comprising:

vacuum air seal for a water filling opening formed in one of the walls of the water bottle, the vacuum air seal comprising an expandable diaphragm that is positioned across a bore passing through the water bottle, the expandable diaphragm being in a substantially unexpanded state prior to the dispensing of water through the water dispensing opening, the vacuum air seal being established when water is dispensed through the water dispensing opening of the water bottle such that a negative pressure is established within the water bottle causing the expandable diaphragm to expand into the bore.

12. A water bottle for use in a humidifier, comprising:

a bottom wall, a top wall, and a circumferentially extending side wall connected between the bottom wall and top wall;

a water dispensing opening formed in one of the walls of the water bottle;

a water filling opening formed in one of the walls of the water bottle;

a selective water dispenser for the water dispensing opening; and a filling cap positioned about the water filling opening, the filling cap defining:

a primary water seal for the water filling opening, the primary water seal comprising a compressible gasket positioned about the water filling opening, the water seal being established through the application of pressure by the filling cap to the compressible gasket to compress the gasket against a portion of the water bottle; and a secondary air seal for the water filling opening, the secondary air seal comprising a sealing member positioned across the water filling opening, the secondary air seal being established when water is dispensed through the water dispensing opening of the bottle such that a relative vacuum is established within the water bottle drawing to the sealing member against a portion of the water bottle, the integrity of the secondary air seal being substantially independent of the pressure applied by the filling cap to the compressible gasket.

13. A water bottle for use in a humidifier, comprising:

a bottom wall, a top wall and a circumferentially extending side wall connected between the bottom wall and the top wall;

a water bottle dispensing cap mounted over a water dispensing opening formed in one of the walls of the water bottle;

a water filling cap releasably mounted over a water filling opening formed in one of the walls of the bottle to facilitate filling the water filling cap defining a water seal that is formed by contact between the water filling cap and a portion of the wall including the filling opening;

the water filling cap including an air seal which utilizes a negative pressure differential in the water bottle that is generated during the dispensing of the water through the water dispensing opening to provide a vacuum air seal for the water filling opening wherein the strength of the air seal is substantially independent of the extent of contact between the water filling cap and the wall including the filling opening.

14. A water bottle for use in a humidifier, comprising:

a bottom wall, a top wall, and a circumferentially extending side wall connected between the bottom wall and the top wall;

a water bottle dispensing mechanism associated with a water dispensing opening formed in one of the walls of the water bottle; and a water filling cap releasably mounted over a water filling opening formed in the one of the walls of the water bottle to facilitate filling; the water filling cap including:

a first element establishing a water seal for the water filling opening, wherein the integrity of the water seal is dependent on the proper mounting of the water filling cap over the water filling opening and a second element establishing an air seal for the water filling opening, wherein the second element is different from the first element and wherein the integrity of the air seal is substantially independent of the proper mounting of the water filling cap over the water filling opening, the air seal being operative when water is dispensed through the water dispensing opening of the water bottle.

15. The water bottle as defined in claim 14 in which the second element comprises a diaphragm that extends across and engages a circumferential margin surrounding the water filling opening.

16. The water bottle as defined in claim 15 in which the diaphragm is a foam plastic element which is associated with the water filling cap.

17. The water bottle as defined in claim 16 in which the circumferential margin surrounding the water filling opening includes a raised lip for aggressive impingement with an outer circumferential area of the foam plastic element.

18. The water bottle as defined in claim 16 in which the first element comprises a compressible gasket seal surrounding the foam plastic element for engagement with a raised circumferential surface surrounding the raised lip around the water filling opening.

19. The water bottle as defined in claim 18 in which the water filling cap is threadably mounted over a circumferential collar surrounding the raised circumferential surface and raised lip around the water filling opening.

20. The water bottle as defined in claim 14 in which the water filling opening is in the sidewall of the water bottle adjacent the bottom wall.

21. The water bottle as defined in claim 20 in which the top wall includes a centrally positioned handle for carrying and maneuvering the water bottle, the water filling opening in the sidewall of the water bottle also being centrally positioned in the water bottle.

22. The water bottle as defined in claim 21 including a recessed area in the water bottle around the water filling opening.

23. A water bottle for use in a humidifier, including:

a bottom wall, a top wall and a circumferentially extending sidewall connected between the bottom wall and top wall;

a water bottle dispensing cap mounted over a water dispensing opening formed in the bottom wall of the water bottle;

a water filling opening formed in one of the walls of the water bottle, a circumferentially extending raised lip surrounding the water dispensing opening, a circumferential collar including a raised laterally extending circumferential surface extending above and surrounding the raised lip, and an externally threaded wall along an outer periphery of the circumferential collar; and a water filling cap including an internally threaded outer periphery for threadable engagement with the externally threaded wall of the circumferential collar, a compressible gasket seal within the internally threaded outer periphery for engaging the raised laterally extending circumferential surface of the circumferential collar to provide a water seal, and a foam diaphragm for engaging the raised lip surrounding the water filling opening to provide an air seal when water is dispensed through the water dispensing opening.

* * * * *